United States Patent [19]

Croopnick et al.

[11] Patent Number: 4,529,668

[45] Date of Patent: Jul. 16, 1985

[54] ELECTRODEPOSITION OF AMORPHOUS ALLOYS AND PRODUCTS SO PRODUCED

[75] Inventors: Gerald A. Croopnick, Trabuco Canyon; David M. Scruggs, San Juan Capistrano, both of Calif.

[73] Assignee: Dresser Industries, Inc., Dallas, Tex.

[21] Appl. No.: 612,860

[22] Filed: May 22, 1984

[51] Int. Cl.[3] ..... C25D 3/56

[52] U.S. Cl. ..... 428/665; 204/43.1; 420/431

[58] Field of Search ..... 204/43.1, 44.5, 44.6, 204/123; 428/660, 670, 680, 681, 665; 75/123 B; 420/431, 435, 441, 456

[56] References Cited

U.S. PATENT DOCUMENTS

| | | | |
|---|---|---|---|
| 4,019,910 | 4/1977 | Mallory, Jr. | 106/1 |
| 4,101,389 | 7/1978 | Uedaira | 204/44 |
| 4,160,854 | 7/1979 | D'Silva | 428/607 |
| 4,264,641 | 4/1981 | Mahoney et al. | 427/30 |
| 4,268,584 | 5/1981 | Ahn et al. | 428/620 |
| 4,297,135 | 10/1981 | Giessen et al. | 75/123 B |
| 4,341,846 | 7/1982 | Hough et al. | 428/670 |
| 4,397,812 | 10/1983 | Mallory, Jr. | 420/441 |

FOREIGN PATENT DOCUMENTS

| | | | |
|---|---|---|---|
| 2106145 | 4/1983 | United Kingdom | 204/192 C |
| 453444 | 4/1975 | U.S.S.R. | 204/44.5 |
| 475422 | 10/1975 | U.S.S.R. | 204/44.5 |
| 515839 | 7/1976 | U.S.S.R. | 204/44.5 |
| 527488 | 12/1976 | U.S.S.R. | 204/44.5 |
| 521359 | 1/1977 | U.S.S.R. | 204/44.5 |

OTHER PUBLICATIONS

G. Zhelis et al., Zashchita Metalloy, vol. 17, No. 5, pp. 594–596, Sep.–Oct. 1981.

Electrochemical Science & Technology (2/1972) vol. 119, No. 2, entitled Structure of Non Crystalline Co–25 a/o W Electrodeposit, pp. 168–172 by T. Omi and H. Yamamoto and H. L. Glass.

Pulsed Electrodeposition of Amorphous and Composite Alloys (9/1/1983) by rolf Weil & Chin–Chang Nee, U.S. Army Research Office, Contract No. DAAG–2-7–60–C–0056, Stevens Institute of Technology.

Journal of Magnetism and Megnetic Materials 19 (1980), pp. 157–158 entitled Electrodeposited Amorphous Alloys with High Permeabilities by G. Dietz and H. Bestgen.

J. Appl. Phys. 50(4), Apr. 1979, Department of Eng'g and Applied Science, Yale Univ. New Haven Conn. (pp. 2713–2719) entitled Structural Characterization of Amorphous Electrodeposited Cobalt–Phosphorus Alloys by G. C. Chi and G. S. Cargill, III.

Electrochemical Science and Technology (Jun. 1974) Electrodeposition of an Amorphous Cobalt Rhenium Alloy by P. J. Cote, G. P. Capsimalis, and V. P. Greco (pp. 776–777).

Metals Handbook Ninth Edition, vol. 5, (ASM) Surface Cleaning, Finishing, and Coating (pp. 170–187 entitled Hard Chromium Plating by Hyman Chessin); and (pp. 219–242 entitled Electroless Nickel Plating by William D. Fields).

*Primary Examiner*—G. L. Kaplan

*Attorney, Agent, or Firm*—Fulwider Patton Rieber Lee & Utecht

[57] ABSTRACT

An electrodeposition process for depositing a boron-containing amorphous metallic layer onto a cathode from an electrodeposition bath having borophosphoric acid, dimethylamineborane or diethylamineborane; an ammonium salt of a hydroxycarboxylic acid or amino acid; and a source of the metallic ions. In one embodiment, tungsten-cobalt-boron amorphous alloys are deposited onto the cathode from a bath having borophosphoric acid, an ammonium salt of a hydroxycarboxylic acid or amino acid, a tungsten-containing salt and a cobalt-containing salt. In the preferred embodiment, the tungsten-containing salt is sodium tungstate, the cobalt-containing salt is cobalt sulphate, and the ammonium salt of a hydroxycarboxylic acid is ammonium citrate or ammonium tartrate. A range of bath compositions may be utilized to deposit the amorphous tungsten-cobalt-boron alloys onto the cathode, such alloys having high hardness and wear resistance and also having sufficient ductility to avoid cracking of the amorphous layer in fabrication and use. The electrodeposition process is preferably conducted at a voltage greater than the hydrogen over-voltage of the bath composition, and at a current density greater than about 20 milliamps per square centimeter.

22 Claims, 6 Drawing Figures

ELECTRODEPOSITION OF AMORPHOUS ALLOYS AND PRODUCTS SO PRODUCED

BACKGROUND OF THE INVENTION

This invention relates to the electrodeposition of metallic coatings, and, more particularly, to the electrodeposition of amorphous alloys.

Metals normally exist in the crystalline state at ambient temperature, with the atoms of the metallic crystal arranged in a lattice having a periodically repeating structure. Metals can also exist in the amorphous state at ambient temperature. In the amorphous state, a metal has no crystallographic structure or lattice, and there is no short range or long range repeating order to the metallic structure. There is also no grain structure in amorphous metals, inasmuch as grains are a direct result of the presence of a crystalline structure.

Some amorphous materials can be made extremely hard and wear resistant, while at the same time highly corrosion resistant because of the absence of preferred orientations, grain boundaries and other defects. Additionally, some very hard and wear-resistant amorphous materials may also have considerably greater ductility than that of crystalline materials of comparable hardness and wear resistance. Even a few percent of ductility in such a hard, wear-resistant material can be highly significant, inasmuch as one drawback of many such materials is their tendency to crack during fabrication, use, or temperature cycling. When the material cracks, particularly if the wear-resistant material is used as a coating, its effectiveness may be lost, as the continued wearing action tends to remove flakes of the coating by spalling. Amorphous materials offer the potential of combining wear and corrosion resistance with sufficient ductility to prevent cracking and spalling, presenting attractive design possibilities in avoiding wear damage to other materials, as by the application of an amorphous wear-resistant coating.

Metals typically form from the liquid state as crystals, and special care must be taken to produce the amorphous state, when that state is desired. It has long been known that amorphous metals may be prepared by cooling a liquid metal of appropriate composition very rapidly from the liquid to the solid state. (See, for example, U.S. Pat. No. 3,297,436.) When a metal having the ability to exist as an amorphous structure, known as a glass former, as quenched from the liquid state at a cooling rate on the order of $10^{5°}$ C. per second or greater, an amorphous structure is formed. Various types of apparatus have been developed to produce rapidly quenched amorphous materials as ribbons or powders. More recently, it has become possible to produce amorphous structures by passing a high intensity heat source over a crystalline structure of appropriate composition, so that the surface of the crystalline structure is melted and rapidly cooled against the remaining metal as a heat sink, thereby producing an amorphous surface structure. Lasers or electron beams may conveniently be used as the high intensity heat source.

All of the techniques for producing amorphous metals utilizing a high cooling rate from the liquid state have advantages in certain instances, but in other situations cannot be used to produce an amorphous structure. For example, it would be desirable to deposit a protective amorphous layer having high wear resistance and acceptable ductility on the inside surface of a cylindrical bore, as for example in producing a highly wear-resistant cylinder housing or pump housing bore. Fabrication techniques utilizing specialized apparatus employing a high cooling rate cannot be readily used to fabricate such a structure.

A promising alternative approach to producing amorphous metals is electrodeposition. Under the proper conditions of bath composition, voltage and current parameters, an amorphous layer may be deposited on a cathode by electrodeposition. For the most part, the electrodeposition of amorphous alloys has been limited to a few demonstration systems of little direct practical interest, and there are no known instances of the electrodeposition of high-hardness, wear-resistant, moderately ductile amorphous alloys. If a technique could be found to produce such materials it would then be possible, for example, to produce highly wear-resistant barrel liners by replacing the conventional low-ductility chromium cylinder liner coating with an amorphous layer that would resist spalling of the coating. Spalling often is observed following repeated thermal and stress cycles of a barrel having a chromium cylinder liner coating. Many other such applications may be envisioned, including, for example, pump housings, instrument bores, piston rings, cylinder housings, bearings, and bearing races.

Thus, there is a need for a process for preparing coatings of high-hardness, wear-resistant, moderately ductile amorphous alloys by electrodeposition. Inasmuch as it has been previously observed that many such amorphous materials contain metalloids such as boron, the process will desirably allow the electrodeposition of a boron-containing amorphous alloy directly from an aqueous electrodeposition bath under conditions that are sufficiently reproducible and forgiving of minor processing variations that the electrodeposition process may be used commercially and to produce relatively large coated structures. The present invention fulfills this need, and further provides related advantages.

SUMMARY OF THE INVENTION

The present invention resides in an electrodeposition process and bath producing a wide variety of amorphous electrodeposited coatings or layers containing boron, and in the resulting product. The electrodeposited alloy is preferably an alloy of tungsten, cobalt and boron, with optional substitution of other metals such as, for example, rhenium, iron, or ruthenium for some of the tungsten or cobalt. The deposited alloy is hard, wear resistant, and has sufficient ductility to avoid cracking or spalling during use, and further is corrosion resistant and relatively economical to manufacture. The coatings produced by the process of the invention are therefore candidates to replace conventional hard crystalline coatings such as nickel or chromium, which are less wear-resistant, and also have a greater tendency to crack, flake and spall because of their lower ductility.

In accordance with the invention, an electrodeposited amorphous alloy contaning the metalloid boron is prepared from an electrodeposition bath consisting essentially of borophosphoric acid, dimethylamineborane, or diethylamineborane; an ammonium salt of a hydroxycarboxylic or amino acid; and a source supplying the metallic species desired for co-deposition with the boron. The source of the metallic species may be dissolved metallic salts or consumable anodes, for example. In one embodiment, an electrodeposited amorphous alloy consisting essentially of tungsten, cobalt and boron may be electrodeposited from an electrodeposition bath consisting essentially of a cobalt-containing salt, a tungsten-containing salt, an ammonium salt of a hydroxycarboxylic acid, and borophosphoric acid. The electrodeposition bath is preferably adjusted to a pH of from about 7 to about 10, and the electrodeposition of a layer onto a cathode is accomplished at a current density of greater than about 20 milliamps per square centimeter (ma/sq. cm.).

More specifically, the preferred tungsten-cobalt-boron amorphous alloy of the invention is deposited from an electrodeposition bath containing cobalt sulphate, sodium tungstate, ammonium citrate or ammonium tartrate or a mixture thereof, and borophosphoric acid. The electrodeposition bath may also contain a base such as an hydroxide in an amount sufficient to adjust the pH of the bath to about 7 to about 10, preferably about 8.5. Additionally, the bath can include salts containing other ionic species to be co-deposited from the electrodeposition bath, such as salts containing rhenium, iron or ruthenium. The electrodeposition from the bath is conveniently and preferably accomplished onto a cathode at a current density of from about 20 to about 200 ma/sq. cm., and preferably about 35 ma/sq. cm. The electrodeposition is preferably accomplished at an elevated temperature of from about 170° F. to about 180° F.

Within these limitations and preferred operating conditions, the bath compositions may vary widely, yet produce an acceptable amorphous coating. A metallic mole ratio of tungsten-containing salt to cobalt-containing salt of about ten-to-one in the electrodeposition bath typically produces an amorphous deposited coating having about 64 weight percent tungsten, about 34 weight percent cobalt, and about 2 weight percent boron. (As referred to herein, the mole concentration of a compound refers to the mole concentration of the specified species contained therein, unless otherwise stated.) Higher relative amounts of tungsten in the bath produce a coating having higher amounts of tungsten, lower amounts of cobalt, and comparable amounts of boron. For example, a bath having a mole ratio of tungsten-containing salt to cobalt-containing salt of about twenty-to-one typically produces an electrodeposited layer having as much as about 66 weight percent tungsten, about 32 weight percent cobalt, and about 2 weight percent boron. The higher tungsten content results in greater hardness of the coating, without significant loss of ductility. It is found that lower mole ratios of tungsten to cobalt in the electroplating bath result in lower tungsten contents in the coating.

Various combinations of coating thickness, coating hardness, and ductility may be achieved by utilizing, as the ammonium salt of a hydroxycarboxylic acid, either ammonium citrate for thicker, less hard coatings or ammonium tartrate for thinner, harder coatings. Deposition from an ammonium tartrate-containing bath at high current densities produces a tungsten-cobalt-boron amorphous alloy coating of high tungsten content and hardness of from about 1000 to about 1400 Vickers Hardness Number (VHN). Such a coating is useful in lubricated parts subjected to high wear conditions, such as hydraulic cylinders and engine parts.

From the foregoing it will be appreciated that the present invention represents an important advance in the field of highly wear-resistant amorphous alloys. The present invention allows the electrodeposition of boron-containing amorphous alloys of high hardness and wear resistance, and moderate ductility, on surfaces and particularly on surfaces whereupon it was previously impractical to obtain an amorphous metallic coating. Cathodes of irregular or unusual configuration may be readily coated by using a shaped anode. Large cathodes may be coated with an amorphous alloy through the present invention by furnishing a sufficiently large electrodeposition tank and apparatus capable of producing sufficiently high currents. Thus, the technique is economically advantageous for producing large coated parts, as compared with other approaches of producing amorphous strips and then bonding the strips to a part, or hardening the surface layer of a part using a laser. Other features and advantages of the present invention will become apparent from the following more detailed description, taken in conjunction with the accompanying drawings which illustrate, by way of example, the principles of the invention.

DETAILED DESCRIPTION OF THE PREFERRED EMBODIMENT

Figure 1:
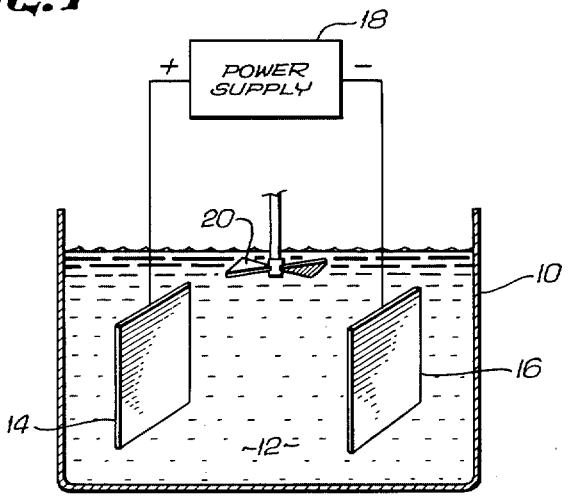
FIG. 1 is a schematic illustration of a preferred electrodeposition apparatus for conducting the process of the present invention.

As illustrated in FIG. 1, an electrodeposition process in which the anode is not consumed is typically accomplished in a tank 10 sufficiently large to hold a quantity of bath 12 containing in solution the elements to be deposited, an anode 14 immersed in the bath 12 and having a positive potential applied thereto, and a cathode 16 also immersed in the bath 12 and having a negative potential applied thereto. The potentials are supplied by a power supply 18 having a current capacity sufficient for the size of the cathode. The bath 12 is preferably gently stirred by a stirrer 20. Under the influence of the potential applied across the anode 14 and the cathode 16, dissociated positive species migrate toward the cathode and are deposited thereon, while electrons may be visualized as traveling from the cathode to the anode to produce an electrodeposition current.

The structure illustrated in FIG. 1 is the presently preferred apparatus for accomplishing electrodeposition in accordance with the present invention, but use of the present invention is not limited to this apparatus, and other means for electrodepositing amorphous alloys in accordance with the present invention may be utilized. For example, the cathode may become a container for the bath, as, for example, where the electrodeposition bath and anode are placed within the container, so that the amorphous alloy is deposited on the inner bore of the cathode. A cuved or irregularly shaped anode may be provided to conform to a curved or irregularly shaped cathode, faciltating the deposition of a desired coating on the cathode. Such modifications are known to those skilled in the art, and the present invention is compatible with such apparatus modifications.

In accordance with a preferred embodiment of the invention, an amorphous layer is coated onto a substrate from an electrodeposition bath, the bath including a cobalt-containing salt, a tungsten-containing salt, an ammonium salt of a hydroxycarboxylic or amino acid, and borophosphoric acid, with the pH of the bath being adjusted to from about 7 to about 10. The amorphous metallic layer is electrodeposited from the bath onto the cathode, at a voltage greater than the hydrogen overvoltage of the bath and at a current density of from about 20 to about 200 ma/sq. cm. The voltage between the cathode and anode is allowed to vary in response to the geometry and current path density of ionic species and the like, but is typically about 2 to 5 volts.

Most preferably, the cobalt-containing salt is cobalt sulphate; the tungsten-containing salt is sodium tungstate; and the ammonium salt of a hydroxycarboxylic acid is ammonium citrate, ammonium tartrate, or mixtures thereof. The pH of the bath is preferably adjusted to a range of from about 7 to about 10, most preferably 8.5, using an addition of a hydroxide such as ammonium hydroxide. Most preferably, the electrodeposition current is about 35 ma/sq. cm. of cathode area. The electrodeposition procedure is preferably conducted at an elevated temperature of from about 170° F. to about 180° F.

The electrodeposition bath is prepared by mixing the proper proportions of the ingredients, as will be set forth in more detail below. The cobalt-containing salt and the tungsten-containing salt, which together are the source for supplying the ionic metallic species codeposited with the boron, may be any such salts wherein cobalt and tungsten are available in a dissociated form in aqueous solution. For example, the preferred cobalt sulphate salt dissociates into positive cobalt ions and negative sulphate ions in aqueous solution. The metallic salts, in combination with the ammonium salt of a hydroxycarboxylic or amino acid, are believed to form on dissolution a soluble organometallic complex. Other useful salts such as acid cobalt salts, including, for example, cobalt chloride or cobalt nitrate, will be known to those skilled in the art. The tungsten ions may also be alternatively supplied, as with tungstic acid that has been made alkaline.

The ionic salts are preferably present in concentrations near their solubility limits, but within the stated mole ratio constraints for particular coatings. If lower concentrations are used, coating deposition rates are reduced. If higher concentrations are used, insoluble salts are formed in the solution, which can interfere with production of the coating and also results in waste. For the preferred sodium tungstate-to-cobalt sulphate metallic mole ratio of twenty-to-one, and a deposition temperature of about 170° F. to about 180° F., the tungsten and cobalt ions are preferably present at mole concentrations of 0.26 moles per liter and 0.013 moles per liter, respectively.

The ammonium salt of a hydroxycarboxylic acid is preferably ammonium citrate, ammonium tartrate, or mixtures thereof. The ammonium salt of a hydroxycarboxylic acid may be provided to the bath in the salt form, or it may be prepared by combining ammonia or ammonium ions and the chosen hydroxycarboxylic acid in the bath or just prior to making a bath addition. A preferred approach is to combine ammonium hydroxide and the chosen hydroxycarboxylic acid immediately prior to making the bath addition, this approach having the advantage that the ammonium hydroxide both supplies the ammonium ions and also assists in adjusting the pH to the preferred range.

Any hydroxycarboxylic acid may be chosen as the basis of the ammonium salt of a hydroxycarboxylic acid, including, for example, the more common forms such as tartaric, citric, gluconic, and glycolic acids. The preferred acid forms of the ammonium salt are tartaric or citric acids, but the other forms have also been found operable. Alternatively, amino acids such as glycinic or glutamic acids have been found suitable, but a hydroxycarboxylic acid is preferred.

Ammonium citrate-containing baths have greater throwing power but produce an electrodeposited amorphous coating having relatively lower hardness, as compared with ammonium tartrate-containing baths. The coating may be deposited in thicknesses of up to about 0.002-0.003 inches in 8 hours from an ammonium-citrate containing bath. An electrodeposition bath containing ammonium tartrate tends to deposit a coating having a greater hardness than that of the ammonium citrate baths, typically on the order of 1200 VHN, which is more wear-resistant than coatings produced with the ammonium citrate-containing bath. The coatings produced with a bath containing ammonium tartrate also tend to be thinner. The coating may be deposited from an ammonium tartrate-containing bath at a rate of about 0.001 inches in 8 hours.

The borophosphoric acid is preferably provided at as high a concentration as possible, but below the solubility limit at the bath temperature. Lower levels are operable, but such a bath is more rapidly depleted and results in lower boron contents in the coating. The preferred borophosphoric acid content for a bath operating temperature of 170° F.–180° F. is about 0.15 to about 0.20 moles boron per liter. Dimethylamineborane or diethylamineborane may be substituted in place of the borophosphoric acid, at the same mole boron content as indicated for the borophosphoric acid. The borophosphoric acid is preferred, however, as it is less costly and less difficult to work with than the stated alternatives.

In another approach, the desired metallic ions for co-deposition with boron may be provided to the bath 12 by consumable anodes. An apparatus similar to that of FIG. 1 is used, but the anode 14 is made of a pure metal or an alloy which, when dissolved into the bath 12 under the influence of the positive electrical potential, acts as the source of the desired metallic species. Multiple anodes may also be used, with the positive potential periodically applied to different anodes so as to achieve a desired mole ratio of metallic ions in solution. With the consumable anode technique, metallic salts may optionally be supplied to the bath 12, particularly to initiate the deposition. Modifications to the consumable anode technique are known to those skilled in the art, and the present invention is compatible with such modifications.

The coatings deposited by the process of the invention may be substantially entirely amorphous, or may under some conditions be partly amorphous and partly nonamorphous. As used herein, an "amorphous coating" is a coating comprising a preponderance of amorphous material, but possibly containing some nonamorphous (crystalline) material. As long as most of the coating is amorphous, some benefits of the amorphous material are obtained.

A typical aqueous electroplating bath in accordance with the invention, and having the preferred tungsten-to-cobalt metallic mole ratio of twenty-to-one, includes the following additions:

TABLE I

| Compound | Grams Per Liter Compound | Grams Per Liter As Metal |
|---|---|---|
| Sodium Tungstate | 81.5 | 45.4 |
| Cobalt Sulphate | 3.66 | 0.77 |
| Borophosphoric Acid | 17.54 | 1.76 |
| Ammonium Citrate | 59.0 | — |
| Ammonium Hydroxide | to pH 8.5 | — |

Alternatively, the ammonium citrate may be omitted and replaced by ammonium tartrate, a typical amount being 49.0 grams per liter (compound). As the bath is depleted, by electrodeposition of the salts, additions of concentrated make-up solution or solid salts are added to the bath to retain the approximate concentrations stated above. However, the compositon of the electroplated coating is not strongly dependent on the bath composition, and minor variations in bath compositions are tolerated and acceptable within normal commercial operations.

The bath composition stated in Table I is preferably electrodeposited under an applied current density of from about 20 to about 200 milliamps per square centimeter, with a most preferred range of from about 35 to about 50 milliamps per square centimeter. For current densities below about 20 milliamps per square centimeter, the conditions for formation of a crystalline coating are increasingly favorable. At current densities greater than about 200 milliamps per square centimeter, the coating thickness builds nonlinearly. Instead, hydrogen evolution increases, thus inhibiting current effectiveness.

The bath composition of Table I deposited under the stated conditions produces an amorphous coating having from about 60 to about 66 weight percent tungsten, from about 32 to about 40 weight percent cobalt, and from about 0.5 to about 2 weight percent boron.

Figure 6:
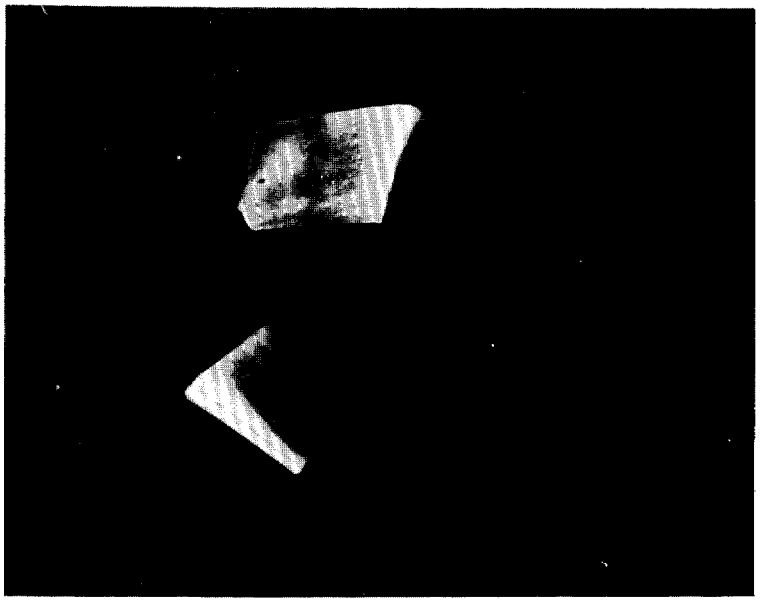
FIG. 6 is a photograph of two tungsten-cobalt-boron amorphous-alloy coated steel substrates, each bent about 90° to illustrate the absence of cracking and the ductility of the coating.
Figure 2:
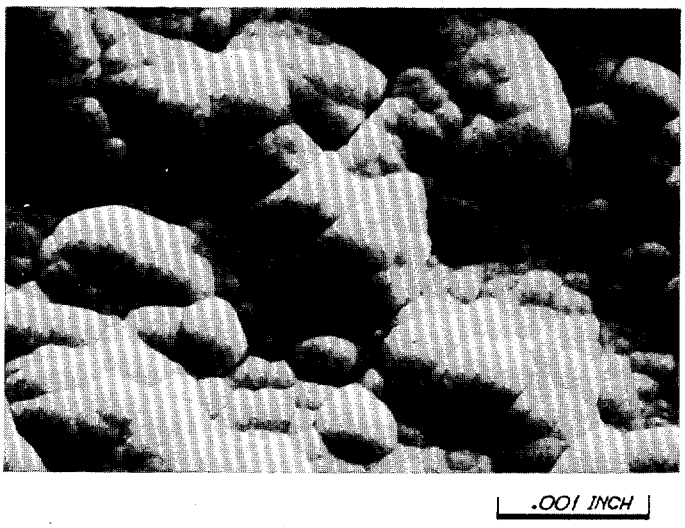
FIG. 2 is a scanning electron micrograph taken normal to the surface of a tungsten-cobalt-boron amorphous alloy deposited on a steel substrate.
Figure 3:
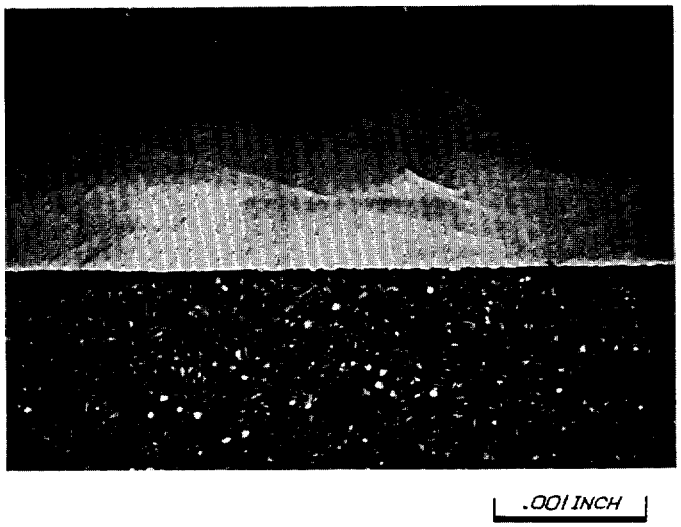
FIG. 3 is a cross-sectional scanning electron micrograph of a tungsten-cobalt-boron alloy deposited on a steel substrate.
Figure 4:
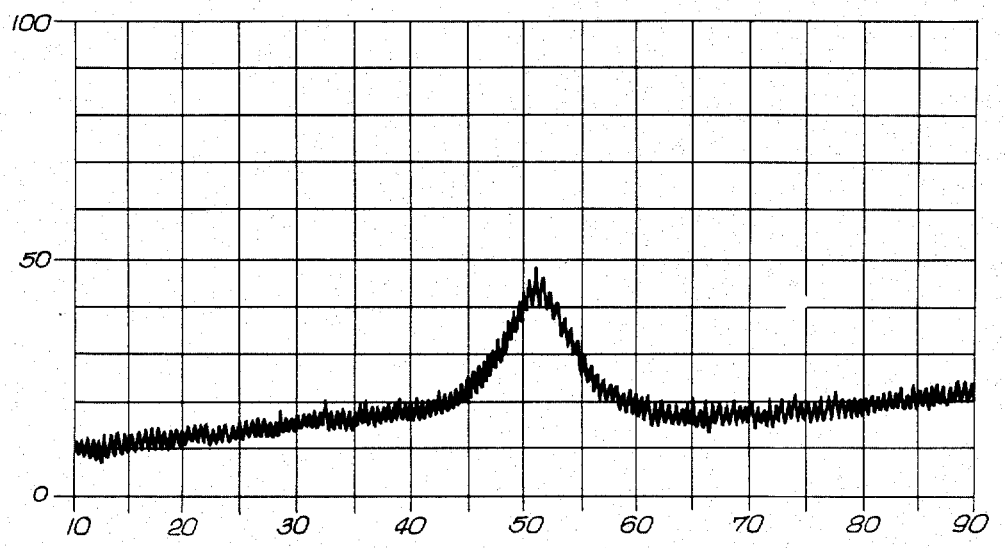
FIG. 4 is an x-ray diffraction pattern of a 0.002 inch thick tungsten-cobalt-boron amorphous alloy deposited on a steel substrate.
Figure 5:
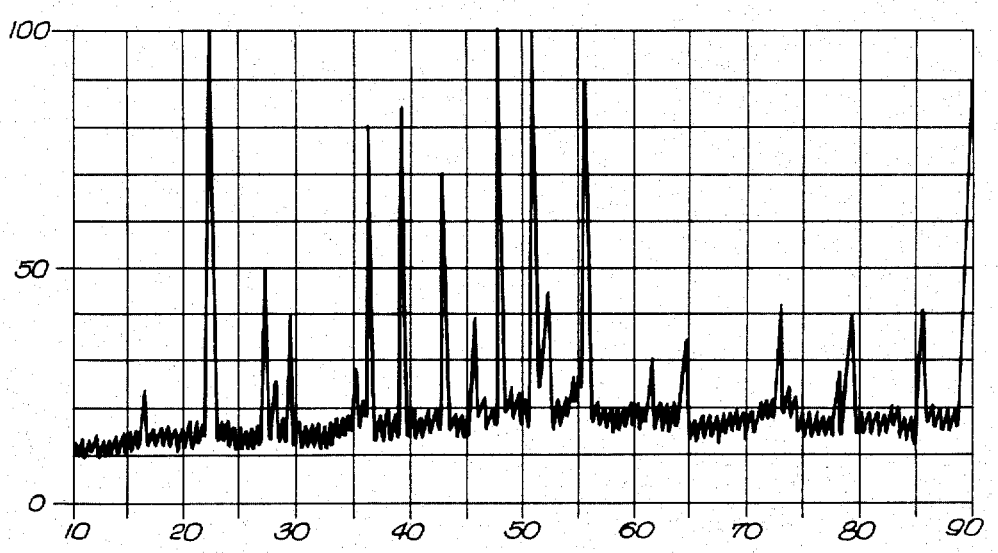
FIG. 5 is an x-ray diffraction pattern of the same sample from which the pattern of FIG. 4 was taken, but after the sample had been heated to 1500° F. for 3 hours and fully converted to the crystalline state.

FIGS. 2 and 3 illustrate the structure of a coating produced by the preferred embodiment of the invention, prepared as described in relation to Table I. The coating is fully dense and continuous. FIG. 4 is an X-ray diffractometer scan of this same coating using cobalt K-alpha radiation. The single broad peak is characteristic of a fully amorphous structure. The sample used to produce FIG. 4 was next heated to a temperature of 1500° F. for 3 hours and the X-ray diffractometer scan of FIG. 5 taken. FIG. 5 shows numerous peaks characteristic of a crystalline structure, showing that the heat treatment has converted the amorphous structure to the crystalline state. Finally, FIG. 6 illustrates the ductility of the amorphous structure. The same amorphous material prepared as described in relation to Table I, and as illustrated in FIGS. 2–4, was deposited onto a substrate of steel shim stock. The steel shim stock can be bent as illustrated in FIG. 6, without cracking of the electroplated amorphous coating. The amorphous coating exhibits substantial ductility, in contrast to conventional hard, crystalline coatings.

The coating compositions of the electrodeposited alloy produced from baths containing ammonium citrate are similar to those from baths containing ammonium tartrate. However, in a fixed deposition time the bath containing ammonium tartrate produces a thinner, harder deposit. Table II presents typical values of thickness, hardness, and structure for coatings produced from baths of the compositions stated above in Table I, for a deposition time of 6 hours and a current density of 35 ma/sq. cm.:

TABLE II

| | Ammonium Citrate 59 g/l | Ammonium Tartrate 49 g/l |
|---|---|---|
| Thickness, inches | .001–.002 | .0002–.0008 |
| Hardness, VHN | 800–1000 | 1000–1400 |
| Structure | Amorphous | Amorphous |

In one modification of the electrodeposition bath of Table I, the cobalt sulphate content is increased tenfold, to about 36.6 grams per liter (termed "10x" in Table III), with all other concentrations and deposition parameters unchanged. In this modification, the rate of build-up of the coating thickness is increased, particularly in conjunction with a bath containing ammonium tartrate. The chemical composition of the electrodeposited coating is modified, as indicated in Table III:

TABLE III

| Complexing Agent | Cobalt Sulphate | Deposition rate* | Coating Composition, Weight % Tungsten | Cobalt | Boron |
|---|---|---|---|---|---|
| Citrate | normal | .03 | 60–66 | 32–40 | 0.5–2 |
| Citrate | 10x | .054 | 55–60 | 40–45 | 0.5–2 |
| Tartrate | normal | .007 | 60–67 | 33–40 | 0.5–2 |
| Tartrate | 10x | .054 | 54–60 | 40–46 | 0.5–2 |

*Milligrams per square inch per hour

All of the coatings of Table III are amorphous when examined by X-ray diffraction, and also show no evidence of a grain structure when examined in cross-section in a scanning electron microscope.

The composition of the coating depends upon, among other things, the mole ratio of the metallic ions in the bath. The following Table IV illustrates the effect on coating composition of variations in the tungsten-to-cobalt mole ratio in the bath, for the preferred deposition approach discussed in relation to Table I above:

TABLE IV

| Tungsten to Cobalt Mole Ratio | Nominal Coating Composition, Weight % Tungsten | Cobalt | Boron |
|---|---|---|---|
| 20:1 | 66 | 32 | 2 |
| 10:1 | 64 | 34 | 2 |
| 2:1 | 56 | 42 | 2 |
| 1:1 | 44 | 54 | 2 |

All of the coatings of Table IV were amorphous, as determined by X-ray diffraction. The coating compositions are nominal values, as the exact compositions can vary by a few percent in the manner previously described. The compositions of the amorphous coatings do not vary linearly with mole ratio in the bath, but the tungsten content of the coating does decrease with decreasing tungsten-to-cobalt mole ratio. It was not possible to produce an amorphous coating from a bath having a tungsten-to-cobalt mole ratio substantially below 1:1 (lower tungsten mole concentration than cobalt concentration).

The tungsten-cobalt-boron coatings described previously may be modified by the addition of salts of other metals to the electrodeposition baths. Such baths produce compositions consisting essentially of tungsten-cobalt-x-boron, where x is another metal. Preferred electrodeposition conditions are identical with those described previously. Such modified compositions yield coatings having properties of particular interest in specific applications.

Rhenium may be added to the coated alloy by providing a soluble rhenium-containing salt, such as ammonium perrhenate, to the electrodeposition bath. The rhenium substitutes for part of the cobalt in the alloy coating, thereby resulting in increased hardness of the coating. Iron may be added to the coated alloy by providing a soluble iron-containing salt, such as ferrous sulphate, to the electrodeposition bath. The iron substitutes for part of the cobalt in the alloy coating, thereby resulting in decreased cost of the coating. It is believed that other metals, such as, for example, ruthenium or nickel, could be added to the coated alloy by providing their soluble salts in the electrodeposition bath, thereby modifying yet other properties such as corrosion resistance.

It will now be appreciated that, through the use of this invention, a hard, wear-resistant and ductile amorphous coating may be applied to surfaces by an electrodeposition process. The electrodeposition process may be utilized to place coatings on a wide variety of parts and surfaces, in areas not sufficiently accessible that other processes for producing amorphous coatings may be utilized. The process of the invention may be utilized to deposit amorphous tungsten-cobalt-boron coatings having hardnesses ranging from about 800 up to about 1800, depending upon the composition of the bath selected. The coating may be made highly corrosion resistant, and is of sufficient ductility to avoid cracking of the coating during electrodeposition, use, or thermal cycling. Although a particular embodiment of the invention has been described in detail for purposes of illustration, various modifications may be made without departing from the spirit and scope of the invention. Accordingly, the invention is not to be limited except as by the appended claims.

What is claimed is:

1. An electrodeposition process for depositing a boron-containing amorphous metallic coating onto a cathode, comprising the steps of:

preparing an electrodeposition bath, the bath consisting essentially of a source of boron selected from the group consisting of borophosphoric acid, dimethylamineborane, and diethylamineborane, an ammonium salt of an acid selected from the group consisting of a hydroxycarboxylic acid and an amino acid, and a source of a metallic species to be co-deposited with the boron, the bath having a pH of from about 7 to about 10; and electrodepositing an amorphous metallic layer from the bath onto the cathode, said step of electrodepositing being conducted at a voltage greater than the hydrogen overvoltage of the bath and a current density greater than about 20 milliamps per square centimeter.

2. The process of claim 1, wherein the source of a metallic species is at least one metallic salt.

3. The process of claim 1, wherein the source of a metallic species is at least one consumable anode.

4. The process of claim 1, wherein the bath contains a cobalt-containing salt and a tungsten-containing salt.

5. The process of claim 4, wherein the cobalt-containing salt is cobalt sulphate.

6. The process of claim 4, wherein the tungsten-containing salt is sodium tungstate.

7. The process of claim 4, wherein the mole ratio of tungsten-to-cobalt in the bath is at least about 1:1.

8. An amorphous metallic coating prepared by the process of claim 4.

9. The process of claim 4, wherein the cathode is a metallic part, and said process produces a coated part.

10. A coated part prepared by the process of claim 9.

11. An article with at least a portion thereof comprising a coating prepared by the process of claim 4.

12. The process of claim 1, wherein the ammonium salt of a hydroxycarboxylic acid is selected from the group consisting of ammonium citrate, ammonium tartrate, and mixtures thereof.

13. The process of claim 1, wherein the pH of the bath is about 8.5.

14. The process of claim 1, wherein the electrodeposition bath contains a hydroxide.

15. The process of claim 1, wherein the electrodeposition current density is from about 35 to about 50 milliamps per square centimeter.

16. The process of claim 1, wherein the bath further includes a salt of a metal selected from the group consisting of rhenium, iron, ruthenium, nickel and combinations thereof.

17. The process of claim 1, wherein said step of electrodepositing is conducted at a temperature of from about 170° F. to about 180° F.

18. The process of claim 1, wherein the cathode is a metallic part, and said process produces a coated part.

19. A process for depositing an amorphous alloy onto a substrate, comprising the steps of:

preparing an aqueous electrodeposition bath consisting essentially of cobalt sulphate, sodium tungstate, borophosphoric acid, and an ammonium salt selected from the group consisting of ammonium citrate and ammonium tartrate, and mixtures thereof, said bath having a pH of from about 7 to about 10; and electrodepositing an amorphous alloy onto said substrate, said step of electrodepositing being accomplished at a current density of from about 20 to about 200 milliamps per square centimeter of cathode.

20. The process of claim 19, wherein the concentration of cobalt sulphate is from about 3.66 to about 36.6 grams per liter, the concentration of sodium tungstate is about 81.5 grams per liter, the concentration of the ammonium salt is from about 45 to about 60 grams per liter, and the concentration of borophosphoric acid is about 17.5 grams per liter.

21. The process of claim 19, wherein the bath further contains a soluble salt of a metal selected from the group consisting of ruthenium, rhenium, nickel, and iron.

22. The process of claim 19, wherein the current density is about 35 milliamps per square centimeter.

* * * * *